United States Patent [19]

Nowak et al.

[11] Patent Number: 4,573,701

[45] Date of Patent: Mar. 4, 1986

[54] RELEASE SKI BINDING

[75] Inventors: Gerhard Nowak, Biedermannsdorf; Alfred Winter; Hans P. Morbitzer, both of Vienna; Klaus Kruschik, Gumpoldskirchen; Robert Taucher, Podersdorf, all of Austria

[73] Assignee: TMC Corporation, Baar, Switzerland

[21] Appl. No.: 572,100

[22] Filed: Jan. 19, 1984

[30] Foreign Application Priority Data

Jan. 21, 1983 [AT] Austria ..... 190/83

[51] Int. Cl.[4] ..... A63C 9/08

[52] U.S. Cl. ..... 280/616; 280/618; 280/624

[58] Field of Search ..... 280/624, 623, 625, 616, 280/617, 618

[56] References Cited

U.S. PATENT DOCUMENTS

| | | | |
|---|---|---|---|
| 2,396,373 | 3/1946 | Henrichsen | 280/616 |
| 3,963,253 | 6/1976 | Rieger | 280/616 |
| 4,113,276 | 9/1978 | Kirsch | 280/616 |
| 4,251,090 | 2/1981 | Weigl | 280/618 |
| 4,269,431 | 5/1981 | Weigl | 280/618 |
| 4,479,664 | 10/1984 | Gertsch | 280/618 |

FOREIGN PATENT DOCUMENTS

| | | |
|---|---|---|
| 2324078 | 11/1974 | Fed. Rep. of Germany . |
| 2533337 | 2/1976 | Fed. Rep. of Germany . |
| 2943209 | 10/1979 | Fed. Rep. of Germany . |
| 3026918 | 7/1980 | Fed. Rep. of Germany . |

*Primary Examiner*—John A. Pekar
*Assistant Examiner*—Michael Mar
*Attorney, Agent, or Firm*—Flynn, Thiel, Boutell & Tanis

[57] ABSTRACT

A release ski binding having a sole plate which in its center area can be pivoted about an approximately vertical axis and can be tilted up about a transverse axis arranged in front of the vertical axis, which sole plate is held on the ski in the skiing position by a resilient holding mechanism, which holding mechanism is responsive to a swivelling movement of the sole plate relative to the ski and, upon reaching a predetermined angle of traverse, effects both an upwardly and also a side opening of a locking mechanism which secures the shoe on the sole plate, and which locking mechanism consists of at least one heel holder pivotal about a transversely extending axis.

10 Claims, 4 Drawing Figures

RELEASE SKI BINDING

FIELD OF THE INVENTION

This invention relates to a ski binding which engages the middle part of a ski boot and, more particularly, to a ski binding incorporating therein a sole plate movable elastically of the ski until a release condition is exceeded.

BACKGROUND OF THE INVENTION

Such release ski bindings are described in German Pat. No. 2 533 337. In these conventional ski bindings the spring of the holding mechanism acts through a piston onto an approximately mushroom-shaped follower member, which is supported pivotally to all sides in the housing of the holding mechanism. The stem portion of the mushroom-shaped follower member is received in a recess of a ski-fixed fitting. In these known ski bindings, the ski shoe is held at its tip or toe by means of a rigid bar on the sole plate. In the case of a fall of the skier to the rear, the ski shoe is therefore released only with great difficulty.

This disadvantage is avoided in the ski binding according to German Pat. No. 2 324 078, however, this binding is complicated in its design. That is, the release mechanism is housed in the space between the base plate and the sole plate. This, however, requires special seal structure to prevent the penetration of snow and dirt therein. Furthermore, the installation is complicated and expensive.

The goal of the invention is to overcome the disadvantages of the conventional designs and to provide a release ski binding of the above-mentioned type, which is simple in its design and in which the ski shoe is reliably held during skiing, however, is immediately released in the case of a fall.

This goal is inventively attained primarily by providing a locking mechanism having two clamping jaws which engage laterally the ski shoe and which are constructed as two-arm levers, which clamping jaws are pivotal on the sole plate about axes which extend in the longitudinal direction of the ski and by the transverse axis of the heel holder being movable in the longitudinal direction of the ski and being under the influence of a pressure spring which urges it toward the tip of the ski.

The concept supporting one-arm clamping jaws, which laterally engage the ski shoe, on a sole plate and to move them through a slide plate with the help of wedge-shaped shoulders into the clamping position is actually already known through the teachings in German OS Nos. 2 943 209 and 3 026 918. However, in these constructions the locking spring acts directly onto the clamping jaws, the load of which is utilized for the automatic release of the ski binding, and which brings about certain inexactnesses compared with the ski bindings of the above-mentioned type in which the angle of traverse of the sole plate is decisive for effecting the opening of the locking mechanism.

Of course, various solutions exist to swing the clamping jaws into the clamping position. However, it has been proven to be particularly preferable if the two clamping jaws are movable into the clamping position by means of clamping wedges movably supported on the sole plate and are under the influence of springs, in particular a pressure or compression spring. In this manner, it is possible to bring about with relatively small spring forces a strong urging of the upper arms of the clamping jaws on the ski shoe.

Furthermore, the invention provides that the two clamping wedges are hingedly connected by a crossbar to a pull rod which extends in a direction toward the tail end of the ski, which pull rod is loaded by the pressure spring in a direction toward the tip end of the ski. This measure contributes to the release of the two wedges occurring evenly.

Furthermore, according to a different characteristic of the invention, the crossbar is connected through a pin, received in a slotted hole in the pull rod, to said pull rod. It is made possible through this measure that the pull rod, which not only handles the opening of the two clamping jaws, but also, as will be discussed below, unlocks the heel holder, carries out these two operations in specified timely intervals one after the other.

According to a further development of the invention, the transverse axis for the heel holder is supported on a piston guided in a hole in the sole plate extending in the longitudinal direction of the sole plate, and a second piston is also movably supported in said hole, which second piston is connected through a transverse bolt to the fork-shaped constructed end of the pull rod. The pressure spring is arranged between both pistons. Furthermore, the second piston has a piston rod secured thereto and which projects from the hole into operative engagement with an operating member of the holding mechanism. The pressure spring is, through this development, not only utilized for urging the heel holder onto the ski shoe during skiing, but at the same time for releasing the two clamping jaws, for example in the case of a fall.

In order to hold the heel holder reliably in the skiing position, various locking mechanisms can be used. However, it has been proven as being particularly preferable to provide at least one hook-shaped locking member hingedly connected to the heel holder, which locking member is under the influence of a torsion spring and in the skiing position of the ski binding grips with its hook under a projection of the sole plate. It is thereby preferable if a stop on the pull rod is associated with the locking member. The stop permits a release of the heel holder prior to the two clamping jaws having opened, so that first the heel and then the toe-piece of the ski shoe is released.

According to a further characteristic of the invention, the heel holder is under the influence of a helical erecting spring supported at one end on a transverse axis supported on the sole plate and at the other end on a transverse axis on the heel holder. This type of support for the erecting spring permits the heel holder to always be under the pressure of the erecting spring, regardless of whether the heel holder is in the position (stepping-in position) which is caused by the pressure spring and which is moved forwardly toward the tip of the ski or in the moved-back position (skiing position) which is caused by a stepping down by the ski shoe.

Finally, the invention provides that the heel holder is guided in a vertical guide slot in the housing on the sole plate. This causes the axis for the heel holder to be substantially protected, since independent from whether the ski shoe is inserted into the ski binding parallel with respect to the vertical longitudinal center plane of the ski or inclined with respect to same, a force is applied onto the axis, which force is always only normal with respect to the axis. Furthermore, a bending of the heel holder during a rough stress or loading of the ski binding is also resisted.

BRIEF DESCRIPTION OF THE DRAWINGS

An exemplary embodiment of an inventive ski binding is illustrated in the drawings, in which.

DETAILED DESCRIPTION

Figure 1:
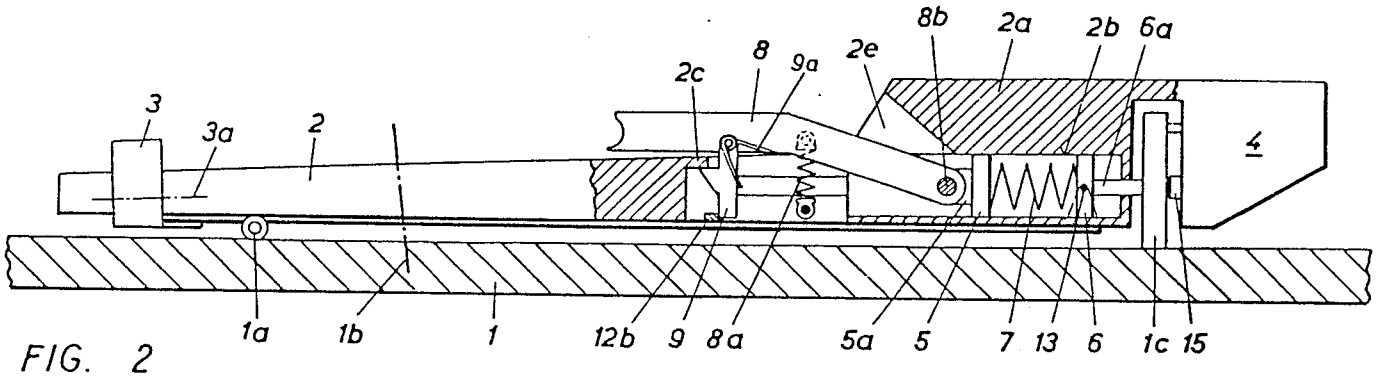
FIG. 1 is a side view of the ski binding in the skiing position, partly in cross section taken along the line I—I of FIG. 2.

Three holding elements are secured to the upper surface of a ski 1, namely a transverse axle 1*a*, a substantially vertical axle 1*b* and a bearing block 1*c*. A sole plate 2 is provided above the ski. The sole plate 2 can be pivoted in the vertical direction about the axis of the transverse axle 1*a* and can be rotated about the axis of the vertical axle 1*b* approximately in a parallel plane with respect to the upper surface of the ski. Two clamping jaws 3 are pivotally supported on axes 3*a* located on the side surfaces of the sole plate 2. The clamping jaws 3 are constructed as two-arm levers and are under the influence of weak torsion springs which are not illustrated and which urge the clamping jaws into engagement with the ski shoe. One such construction is disclosed in a copending application Ser. No. 572 099 entitled RELEASE SKI BINDING, filed concurrently herewith.

The region of the sole plate 2 closest to the tail end of the ski defines a housing 2*a*, on which is secured a holding mechanism 4 and in which is provided an axially extending hole 2*b*. Two axially spaced pistons 5 and 6 are movably supported in the hole 2*b*. A pressure spring 7 is arranged between the two pistons 5, 6. The piston 5 which is closest to the tip of the ski carries a bearing clock 5*a* thereon on which is pivotally supported a fork-shaped constructed heel holder 8 movable about an axis 8*b*. The heel holder 8 is under the influence of an erecting spring 8*a* and is guided in a vertically oriented guide slot 2*e* in the housing 2*a*. The end of the heel holder 8 has a recessed construction which engages, in the skiing position, the heel of the ski shoe. The heel holder 8 together with the two toe clamping jaws 3 hold the ski shoe during skiing reliably on the ski 1. Furthermore, at least one hook-shaped locking member 9 is hingedly mounted on the heel holder 8, which locking member 9 is under the action of a torsion spring 9*a* and grips, in the skiing position, with its hook under a projection 2*c* of the sole plate 2.

The sole plate 2 has in the region of the two toe clamping jaws 3 two approximately trapezoidally shaped recesses 2*d*, in which clamping wedges 10 are supported. The clamping wedges 10 are under the influence of pressure springs 10*a*. The clamping wedges 10 each have upstanding pins 10*b* on their upper side, which pins are received in slotted holes 11*a* of a crossbar member 11. The crossbar member 11 has also an upstanding pin 11*b* in its center, which pin is received in the slotted hole 12*a* of a pull rod 12. The pull rod 12 extends to the housing 2*a* on the sole plate 2 and becomes bifurcated at its end which is remote from the clamping jaws 3. The ends of the two legs or prongs of the pull rod 12 are hingedly connected to the piston 6 by means of a pin 13. Of course the pin 13 is guided on both sides of the piston 6 in guide slots in the housing 2*a*. Furthermore, the pull rod 12 has at least one stop 12*b* thereon designated or adapted to effect a release of the locking member 9. A piston rod 6*a* is attached to the piston 6 and can, for example, be constructed as a bearing for a roller 14 (FIG. 3) to serve as a support for an operating member 15 of the holding mechanism 4.

Figure 3:
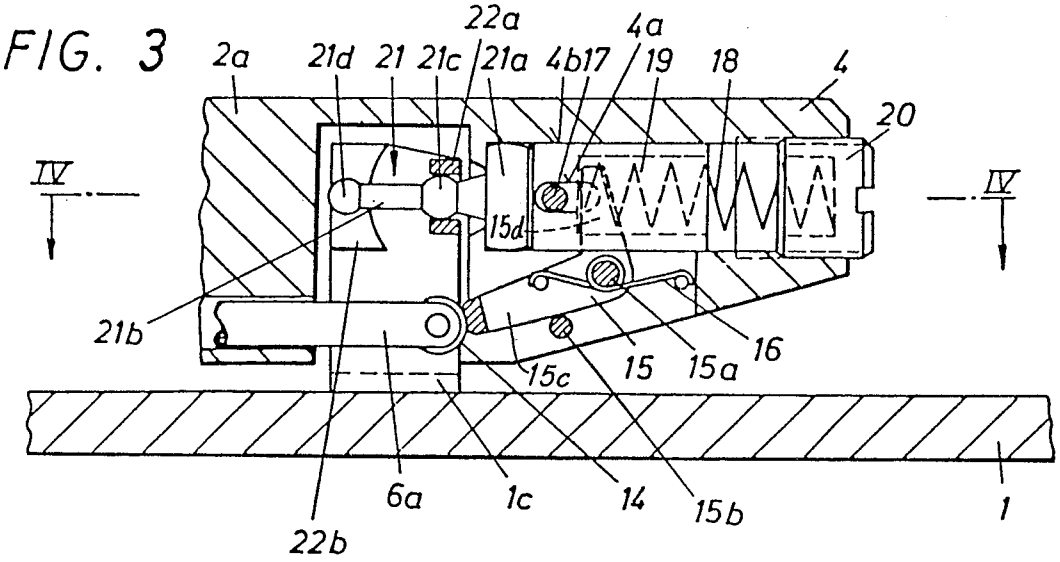
FIG. 3 is a longitudinal central cross-sectional view of a detail of the ski binding.
Figure 4:
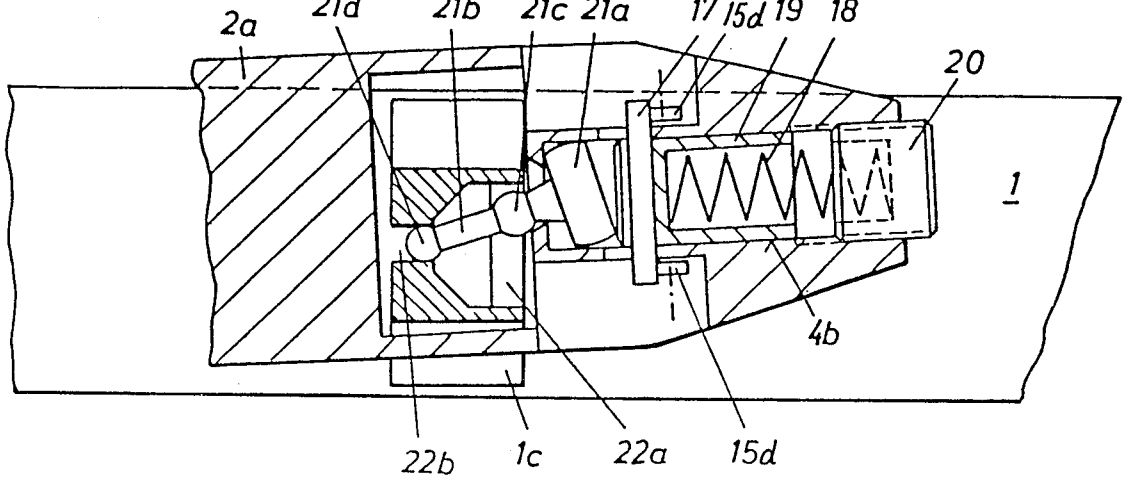
FIG. 4 is a sectional view taken along the line IV—IV in FIG. 3 but wherein the ski binding is laterally deflected.

The operating member 15 in the holding mechanism 4, which is illustrated in FIGS. 3 and 4, is constructed as a toggle lever supported for pivotal movement about an axle 15*a* and which is loaded or biased for movement in the counterclockwise direction by a torsion spring 16. One arm 15*c* of the toggle lever engages the roller 14 and is held in this position by a stop 15*b*. The other, fork-shaped constructed arm 15*d* of the toggle lever 15 engages a transversely extending pin 17 which extends through a pair of laterally aligned slotted holes 4*a* in the holding mechanism 4. A piston 19 which is loaded by a pressure spring 18 is guided in a longitudinal hole 4*b* of the holding mechanism 4 and projects between the legs 15*d* of the toggle lever to engage the pin 17. The initial tension of the pressure spring 18 can be adjusted by means of an adjusting screw 20.

Furthermore, a generally mushroom-shaped follower member 21 having an enlarged head 21*a* is pivotally supported in the hole 4*b* of the holding mechanism 4. The stem portion 21*b* of the follower member has two spherical enlargements 21*c* and 21*d* spaced along the length thereof. The stem portion 21*b* extends through an outwardly diverging conical hole in the bottom wall of the hole 4*b* in the holding mechanism 4. The bearing block 1*c* for the follower member 21, which bearing block is secured to the ski 1, has two guideways thereon, namely a horizontal guideway 22*a* and a vertical guideway 22*b*, of which the guideway 22*a* is associated with the spherical enlargement 21*c* and the other one 22*b* with the spherical enlargement 21*d*.

In the stepping-in position of the ski binding, the heel holder 8 is under the influence of the erecting spring 8*a* in the erected position. The piston 5 is moved under the influence of the pressure spring 7 toward the tip of the ski in the hole 2*b*. The clamping jaws 3 are held in vertical position by the wedges 10 acting through the pressure springs 10*a*. The ski shoe is now, with a slightly lowered tip, first moved between the clamping jaws 3, and thereafter the heel of the ski shoe is stepped down upon. The heel holder 8 is thereby swung counterclockwise and at the same time the pivot 8*b* therefor is moved slightly toward the tail end of the ski. The heel holder 8 and shoe sole form a kind of a toggle joint during the stepping down event. However, by moving the pivot axle 8*b* of the sole holder 8 rearwardly, the pressure spring 7 is tensioned or compressed. The ski shoe is therefore urged forwardly between the toe clamping jaws 3 by the pressure spring 7 acting on the heel holder 8. The heel holder 8 is locked with respect to the sole plate 2 in the lower end position by the locking member 9.

If during skiing, the sole plate 2 is swung in the vertical and/or horizontal plane, then also the follower member 21 is swung, which results in a movement of the piston 19 in a direction toward the tail end of the ski. If thereby the so-called elastic region of the ski binding is exceeded in the horizontal or in the vertical direction, then the toggle lever 15 is swung clockwise by the piston 19 to cause the end of the lever arm engaging the roller 14 to become disengaged from the roller. The pressure spring 7 which is housed in the hole 2b now becomes relaxed because the piston 6 will be driven rearwardly by the spring force from the spring 7. This has the result, that the clamping wedges 10 are pulled back by the pull rod 12, and that also the heel holder 8 is relieved from the pressure of the pressure spring 7, which tries to move it toward the ski shoe. Through the rearward movement of the pull rod 12, the locking member 9 was also unlocked by the stop 12b effecting a disengagement thereof from the projection 2c on the sole plate 2. The heel holder 8 can therefore swing upwardly clockwise under the influence of the erecting spring 8a to facilitate the release of the ski shoe.

The voluntary release of the ski binding occurs by means of a release lever which is supported in the holding mechanism 4, however, is not illustrated in the drawings. Through this lever the arm 15c of the toggle lever 15 is removed from engagement with the roller 14 against the force of the torsion spring 16. The remaining operation corresponds with one occurring during the automatic release of the ski binding.

Figure 2:
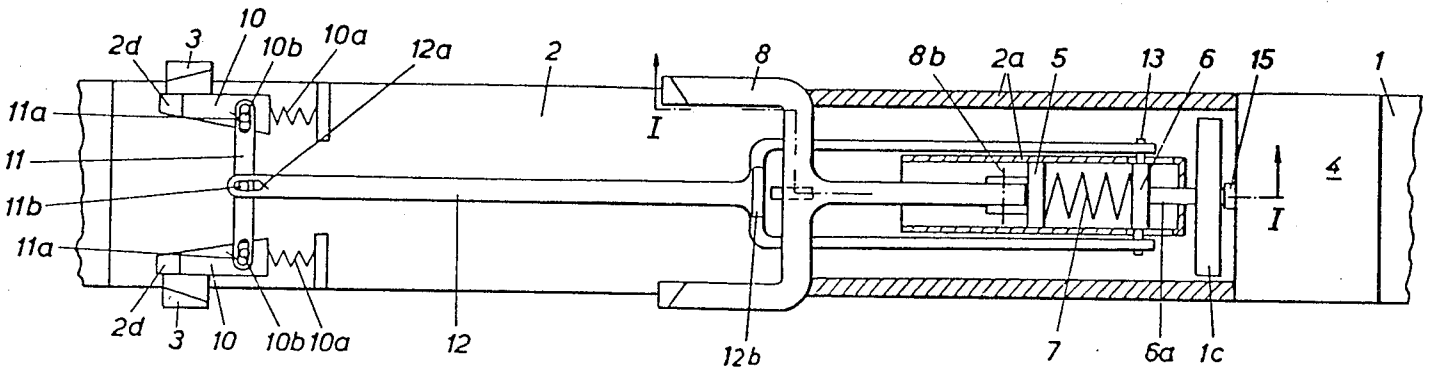
FIG. 2 is a partially sectioned top view of the ski binding.

As soon as the ski shoe has left the ski binding, the pull rod 12 returns with the piston 6 under the influence of the pressure springs 10a, which load the clamping wedges 10 to move them into the position which is illustrated in FIG. 2, and in which the arm 15c of the toggle lever 15, under the influence of the torsion spring 16, rests on the roller 14. The heel holder 8 remains in the swung-up position after the ski shoe has left the binding. The ski binding is therefore ready for the ski shoe to again step thereinto.

Of course the invention is by no means to be limited to the exemplary embodiment which is illustrated in the drawing and which is described above. Rather, various modifications of the same are possible without leaving the scope of the invention. For example, it is possible to use in place of a cross-bar and a pull rod a slide plate hingedly connected to the piston, which piston is adjacent to the tail end of the ski and received in the recess in the sole plate.

The embodiments of the invention in which an exclusive property or privilege is claimed are defined as follows:

1. In a release ski binding comprising a sole plate which can in its central region be pivoted about an approximately vertical axis and about a transverse axis arranged in front of said vertical axis, said sole plate being held on a ski in a skiing position by a resilient holding mechanism, said holding mechanism being responsive to a pivotal movement of said sole plate relative to the ski and, upon reaching a predetermined angle of traverse effecting both an upwardly and also a side opening of a locking mechanism, the improvement comprising wherein said locking mechanism has two clamping jaws which laterally engage the ski shoe and which are constructed as two-arm levers, mounting means for mounting said clamping jaws pivotally on the sole plate and for movement about axes which extend in the longitudinal direction of the ski, wherein a heel holder is provided on said sole plate and which is pivotal about a transverse axle between a ski shoe holding position a ski shoe releasing position, and wherein said transverse axle of said heel holder is supported for movement in the longitudinal direction of the ski and is under the influence of a resilient means for urging said heel holder toward the tip of the ski, and wherein control means are provided for operatively controlling the operation of said clamping jaws and said heel holder.

2. The ski binding according to claim 1, wherein said control means includes wedge means movably supported on said sole plate and wherein said resilient means includes a first pressure spring for urging said wedge means toward said clamping jaws to urge said clamping jaws into a clamping position effecting a holding of the ski shoe to the ski.

3. The ski binding according to claim 2, wherein said wedge means includes two clamping wedges which are connected by a crossbar to which is hingedly connected a pull rod which extends in a direction toward the tail end of the ski, said resilient means including a second pressure spring for urging said pull rod in a direction toward the tail end of the ski when said heel holder is in said ski shoe holding position.

4. The ski binding according to claim 3, wherein said crossbar has a slotted hole therein receiving a pin therein to connect said crossbar to said pull rod.

5. The ski binding according to claim 3, wherein said transverse axle for said heel holder is supported on a first piston movably guided in a hole in said sole plate, said hole extending in the longitudinal direction of said sole plate, and wherein also a second piston is movably supported in said hole and is connected through a transverse pin to a fork-shaped constructed end on said pull rod, said second pressure spring being oriented between said first and second pistons.

6. The ski binding according to claim 5, wherein said second piston has a piston rod secured thereto which projects from said hole and operatively engages an operating member of said holding mechanism.

7. The ski binding according to claim 1, wherein said control means includes at least one hook-shaped locking member hingedly connected to said heel holder, said locking member being under the influence of a torsion spring and, in said ski shoe holding position of said heel holder, grips with its hook under a projection on the sole plate to lock said heel holder to the sole plate.

8. The ski binding according to claim 7, wherein a stop is provided on said pull rod and is adapted to engage and unlock said locking member in response to said resilient holding mechanism exceeding said predetermined angle of traverse.

9. The ski binding according to claim 7, wherein said heel holder is under the influence of a helical erecting spring, which erecting spring engages at one end a transverse axle mounted on the sole plate and at the other end a further transverse axle mounted on said heel holder.

10. The ski binding according to claim 7, wherein said heel holder is mounted on a housing member and is guided in a vertical guide slot on said housing member.

* * * * *